United States Patent [19]

Bubar et al.

[11] 4,178,059

[45] Dec. 11, 1979

[54] ALUMINUM BASE FOR ELECTRIC LAMPS HAVING A PLASTIC COATING FOR IMPROVED CORROSION RESISTANCE

[75] Inventors: Stanley F. Bubar, Chagrin Falls; David L. Jennings, Reminderville, both of Ohio

[73] Assignee: General Electric Company, Schenectady, N.Y.

[21] Appl. No.: 932,228

[22] Filed: Aug. 9, 1978

[51] Int. Cl.[2] ..... H01R 3/02

[52] U.S. Cl. ..... 339/115 R; 339/114; 339/146

[58] Field of Search ..... 339/115 R, 115 C, 114, 339/146, 275 C, 276 C, 277 C, 278 C

[56] References Cited

U.S. PATENT DOCUMENTS

| | | | |
|---|---|---|---|
| 1,658,752 | 2/1928 | Wilford | 339/114 |
| 2,047,023 | 7/1936 | Geiger et al. | 339/146 |

*Primary Examiner*—Roy Lake
*Assistant Examiner*—DeWalden W. Jones
*Attorney, Agent, or Firm*—Ernest W. Legree; Lawrence R. Kempton; Frank L. Neuhauser

[57] ABSTRACT

A screw base for high intensity discharge lamps or for larger sizes of incandescent lamps utilizes a threaded aluminum shell coated with a thin film of polytetrafluoroethylene. The thin film is penetrated at points of maximum contact pressure with the socket to provide electrical continuity while effecting a low friction surface preventing galling and sticking of the base in the socket and permitting easy lamp insertion and removal.

7 Claims, 1 Drawing Figure

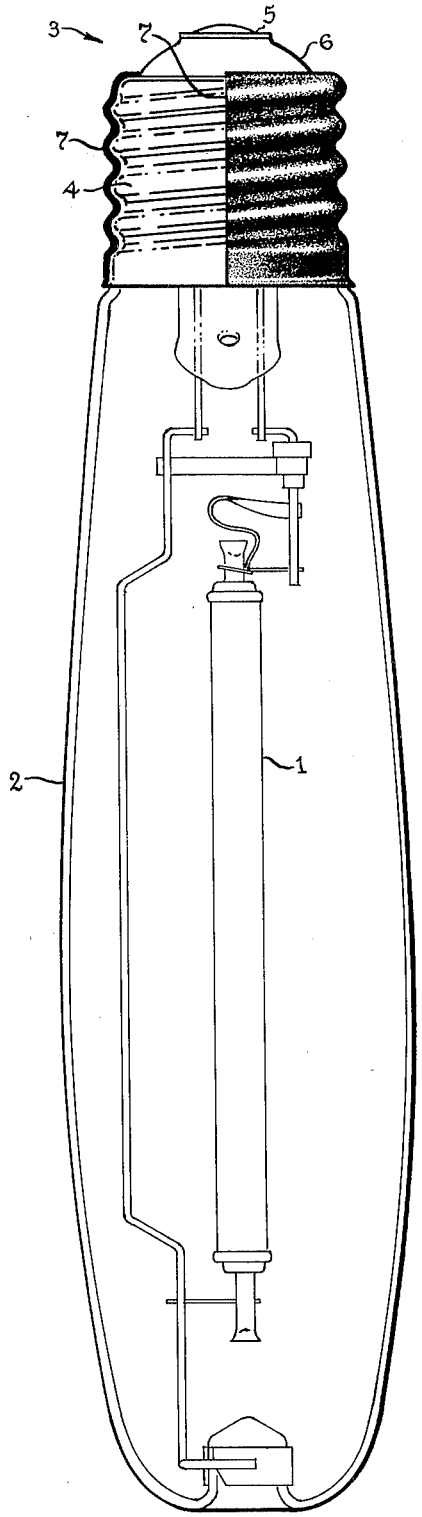
3
7
5
6
7
4
2
1

ALUMINUM BASE FOR ELECTRIC LAMPS HAVING A PLASTIC COATING FOR IMPROVED CORROSION RESISTANCE

The invention relates to Edison or screw-type bases for electric lamps which are screwed into a socket, and makes possible the use of aluminum for the base shells under high temperature or adverse ambient conditions wherein aluminum formerly could not be used.

BACKGROUND OF THE INVENTION

The Edison or common lamp screw base comprises a threaded metal shall, a center contact or eyelet and a molded insulator uniting the shell and eyelet. Such bases have been used with incandescent lamps since the turn of the century and are disclosed in U.S. Pat. No. 774,404—Swan (1904). They come in various sizes ranging from miniature through medium to mogul. They include variants such as the three-contact base used with three-way lamps which comprises a contact ring intermediate the base shell and the eyelet, as disclosed in U.S. Pat. No. 2,519,328—Whitmore et al.

The metal parts of such bases were originally made of brass which is corrosion resistant and easy to solder. After World War II aluminum became much cheaper than brass and during the 1950's it was substituted for brass in the base shells of the medium size bases used with common household incandescent lamps. However aluminum tends to gall, that is fret and wear, more than brass and is not as corrosion resistant; up to now it has not been possible to use aluminum bases with lamps operating at very high temperatures or under adverse ambient conditions. Virtually all high intensity discharge lamps utilize brass or nickel-plated brass screw-in bases. Also the large sizes of incandescent lamps and incandescent lamps used in outdoor signs still utilize brass bases.

SUMMARY OF THE INVENTION

The bases for high intensity discharge lamps must be resistant to corrosion at temperatures up to 210° C. in a variety of atmospheres for a 24,000 hour average life. They must have freedom from galling and sticking in the socket to permit insertion of the lamp and its removal at the end of life without breakage. This is important from the point of view of low service cost and also safety of maintenance personnel. The object of our invention is to provide a base having an aluminum shell and meeting these requirements.

In accordance with our invention we provide a base for an electric lamp whereof the shell is aluminum externally coated with a thin self-adherent layer of soft protective plastic material having lubricative properties by reason of a low coefficient of friction, 0.1 or less. By the shell we mean the main body portion of the base, generally threaded, which is destined to penetrate into and make electrical contact with a complementary hollow conductive member or shell in the lamp socket. Preferred materials are polymeric fluorocarbons such as polytetrafluoroethylene. This material is commercially available under the trademark Teflon and is sold by E. I. du Pont and Co. Also suitable is polyphenylene sulfide. The thin film is easily penetrated at points of maximum contact pressure with the base shell to provide electrical continuity, but otherwise remains in place providing protection against corrosion and serving as a lubricant for easy lamp removal.

DESCRIPTION OF DRAWING

The single FIGURE of the drawing illustrates a lamp having a base shell of aluminum provided with a polytetrafluoroethylene coating according to the invention.

DETAILED DESCRIPTION

The aluminum surface to be coated should be thoroughly cleaned, preferably grit blasted just prior to coating, to maximize adhesion. The preferred coating technique is an electrostatic process using a suspension of the polymeric material in water. The spray is at a high positive potential (e.g. 76,000 VDC) with respect to the surface to be coated. The coating may also be applied by painting, or dipping in the suspension. After application, the coating is baked at a temperature of approximately 450°–650° F. for about 3–4 minutes. The actual time and temperature may be varied depending on composition and final coating requirements.

The coating should be continuous and we have found that a minimum thickness of about 0.0005" is desirable to assure this. There is no advantage in coatings in excess of 0.0015" and excessive thickness simply wastes material. In general a coating approximately 0.001" thick is preferred. The polymeric material is relatively expensive and some economy may be achieved by loading it with a filler; a preferred filler is graphite which has the advantage of good lubricative properties and also electrical conductivity.

The polymeric material coating flows with time under high localized pressure and ultimately the contact desired is achieved by cutting through the film to provide a direct metal to metal contact between base and socket. Sometimes the film penetration may fail to occur immediately when the lamp is screwed into the socket. In such case the graphite may assure electrical continuity when the lamp is switched on immediately, until the metal to metal contact is established.

The drawing illustrates a high pressure sodium vapor discharge lamp in which the invention is embodied. The lamp comprises an alumina ceramic sodium-containing discharge tube 1 mounted within an outer vitreous envelope 2 having a mogul base 3 attached to its upper end. The base comprises a threaded aluminum shell 4 and a brass eyelet 5 mounted on an insulating web 6, the shell and eyelet serving as contact terminals to which the inleads are connected.

In accordance with the invention, a coating 7 of polytetrafluoroethylene is applied to the aluminum shell 4. The film is shown on the right half of the shell only, but also appears in section, exaggerated in thickness, at the edge of the left half. The film is about 0.001" thick and contains graphite or carbon black as filler which gives it a black appearance.

The coefficient of friction of the coating against nickel is 0.04. The lamp screws readily into a threaded socket which conventionally utilizes a nickel-coated threaded brass shell. The pressure developed when screwing in the lamp is sufficient to assure piercing of the coating and metal to metal contact. An aluminum base with the coating achieves the desired corrosion resistance and life and costs much less than a brass base.

What we claim as new and desire to secure by Letters Patent of the United States is:

1. A screw base for an electric lamp of the kind comprising a threaded metal shell and a center contact mounted on an insulator uniting it to the shell, said shell being of aluminum coated externally with a thin self-adherent layer of soft protective plastic material having lubricative properties and a coefficient of friction less than 0.1, said layer being penetrable at points of maximum contact pressure when screwed into a socket in order to provide circuit continuity, said layer otherwise remaining in place to provide protection against corrosion of the aluminum and serving as a lubricant for easy lamp removal from the socket.

2. A base as in claim 1 wherein the plastic material is a polymeric fluorocarbon.

3. A base as in claim 1 wherein the plastic material is polytetrafluoroethylene.

4. A base as in claim 1 where the plastic material is polyphenylene sulfide.

5. A base as in claim 1 wherein the plastic material is polytetrafluoroethylene in a thickness of at least 0.0005'.

6. A base as in claim 1 wherein the plastic material is a polymeric fluorocarbon containing a filler of graphite or carbon black.

7. A base as in claim 1 wherein the plastic material is polytetrafluoroethylene in a thickness from approximately 0.0005" to 0.0015" and containing graphite or carbon black as a filler.

* * * * *